US006250485B1

(12) United States Patent
Olson

(10) Patent No.: US 6,250,485 B1
(45) Date of Patent: Jun. 26, 2001

(54) BOOM ARTICULATION ASSEMBLY FOR AERIAL BOOM SECTIONS

(75) Inventor: James A. Olson, Watertown, SD (US)

(73) Assignee: Terex Telelect, Watertown, SD (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/902,719

(22) Filed: Jul. 30, 1997

(51) Int. Cl.[7] ..... B66C 23/82; B66C 23/06; E04G 1/00

(52) U.S. Cl. ..... 212/260; 212/255; 182/2.8

(58) Field of Search ..... 212/255, 260, 212/261, 294, 295, 297, 299, 300, 227, 231, 232, 237, 238; 182/2.1, 2.3, 2.6, 2.8

(56) References Cited

U.S. PATENT DOCUMENTS

| | | | | |
|---|---|---|---|---|
| 3,132,718 | * | 5/1964 | Pierce, Jr. | 182/2.8 |
| 3,235,097 | * | 2/1966 | Ohman | 212/300 |
| 3,378,103 | | 4/1968 | Zwight et al. | 182/141 |
| 3,411,606 | | 11/1968 | Oldakowski et al. | 182/2 |
| 3,474,682 | | 10/1969 | Prescott | 74/89.2 |
| 3,516,514 | | 6/1970 | Malloy et al. | 182/4 |
| 3,616,940 | | 11/1971 | Millner, Jr. | 212/59 |
| 4,222,457 | | 9/1980 | Ashworth | 182/2 |
| 4,461,369 | * | 7/1984 | Amador | 212/300 |
| 4,602,462 | | 7/1986 | Anderson | 52/119 |
| 4,646,875 | | 3/1987 | Sholl | 182/2 |
| 4,687,073 | | 8/1987 | Ashworth | 182/2 |
| 4,754,840 | | 7/1988 | MacDonald et al. | 182/2 |
| 4,888,941 | | 12/1989 | Gerber | 56/328.1 |
| 4,944,364 | | 7/1990 | Blasko | 182/2 |
| 5,016,767 | * | 5/1991 | Thibault | 212/300 |
| 5,082,085 | | 1/1992 | Ream et al. | 182/2 |
| 5,113,969 | | 5/1992 | Drolet et al. | 182/2 |
| 5,249,643 | | 10/1993 | Backet et al. | 182/2 |
| 5,307,898 | | 5/1994 | Purdy et al. | 182/63 |
| 5,465,808 | * | 11/1995 | Musgrove | 182/2.8 |

FOREIGN PATENT DOCUMENTS

| | | | | |
|---|---|---|---|---|
| 1920593 | * | 11/1970 | (DE) | 212/299 |

* cited by examiner

*Primary Examiner*—Eileen D. Lillis
*Assistant Examiner*—R. B. Johnson
(74) *Attorney, Agent, or Firm*—Andrus, Sceales, Starke & Sawall

(57) ABSTRACT

A mobile aerial apparatus includes a lower boom and an upper boom and pivotally mounted to a pedestal. A lift cylinder pivots the lower boom. An articulated assembly includes a common pivot support secured to the articulated ends of the booms on a common axis. A link unit has a common pivot member on said common pivot axis. An upper boom cylinder unit has a cylinder pivotally connected on the common pivot axis and a piston rod connected to an upper boom connector of the link unit. A lower boom cylinder unit has a cylinder pivotally connected on the common pivot axis and a piston rod connected to a lower boom connector of said link unit. The connections to the link unit form a triangular assembly with the pivot axis being parallel to each other.

3 Claims, 10 Drawing Sheets

BOOM ARTICULATION ASSEMBLY FOR AERIAL BOOM SECTIONS

BACKGROUND OF THE INVENTION

This invention relates to a boom articulation assembly or apparatus for aerial boom sections and particularly to a interconnection between the boom sections for articulating a vertical rotation of an upper boom relative to a lower boom and providing for positioning through angles of articulation up to 275 degrees.

Mobile aerial devices are well known for various applications. The aerial device generally include a first boom which is pivotally supported to a pedestal of a mobile support. The first boom is supported for pivoting upwardly from the mobile support. The second boom is pivotably coupled to the outer end of the first boom for pivotal movement into a collapsed storage position and for extension of the second boom from the first boom. The second boom is mounted for pivoting about the outer-end position of the first boom. A work platform, such as a bucket or basket, is generally pivotally mounted to the outer end of the second boom for supporting equipment and/or personnel for servicing of raised or elevated devices. Thus, mobile aerial devices are commonly used in the construction and servicing of overhead lighting systems; raised signs, tree trimming and other similar applications. Each boom may be a single member boom, telescoping boom member and may include additional booms connected to the lower or upper boom.

The ability of an articulating system to vary the angle between the upper and lower booms is significant in producing the versatility desired or necessary for workers to reach various areas of the work area without the need for continuously repositioning of the mobile support. Such articulation systems permits locating of the mobile support in a convenient stable position relative to the actual raised work area. The increased upper boom articulation allows the workers to reach some positions from two angular positions of the lower boom. If access is prohibited by obstructions such as power of telephone lines, trees, or structures for one position of the lower boom, an alternate articulation will permit a safe access. For example, with the lower boom raised 45 degrees and the upper boom open 95 degrees, the operator could reach a position directly over head. The same position could be reached with the lower boom raised 135 degrees from the stowed position and the upper boom open 265 degrees from the lower boom.

The prior art has disclosed various chain and cable or multiple pivoting link connections between the booms in combination with hydraulic cylinder units for the relative articulation of the booms. Alternate systems have disclosed various linkages interconnecting of the booms to each other in combination with operating cylinder units.

In practice, the booms are mounted for a collapsed storage positioning with the upper booms located in side-by-side relation above the lower boom. Alternatively, the upper boom can be stored in stacked relationship to the lower boom.

SUMMARY OF THE PRESENT INVENTION

The present invention is particularly directed to an articulation assembly or apparatus for coupling the outer aligned ends of a lower boom and an upper boom including a single link unit in combination with hydraulic actuated cylinder or other suitable means connecting the link unit to the booms with the link unit and the booms pivotally mounted on a common pivot axis for independent pivoting thereon for articulated positioning of the booms relative to each other by pivoting of the link unit and thereby the booms. The apparatus permits location of the outer end of the upper boom, and in a preferred construction, through an angle inclusive of up to 275 degrees.

In accordance with the present invention, a special link member or unit pivots on a common pivotal support structure for connection with the articulated ends of the upper and lower booms separately pivotal thereon. The link member or unit is rotatable about the articulated ends of the booms on a common axis defined by the pivotal support structure between the two booms. The link unit includes spaced pivot connections located in orientation with respect to the common axis for connection about the articulation ends of the booms in the collapsed position. A first or lower hydraulic cylinder unit is interconnected between the lower boom and an aligned cylinder pivot connector of the link unit. A second or upper cylinder unit is connected between the upper boom and an aligned cylinder pivot connector of the link unit. The cylinder units are sequentially or simultaneously activated to position the upper boom relative to the lower boom.

The present invention can be applied to side-by-side booms and also to stacked booms, and has been particularly applied to side-by-side booms.

In the side-by-side boom unit or structure, the booms and the link unit are mounted on a common pivot axis including the boom pivot supports. The upper cylinder unit is connected to the upper boom and an upper pivot connector of the link unit to move the upper arm through a first stage of articulation relative to the lower boom. The lower cylinder unit is connected to the lower boom and a lower pivot connector and moves the upper boom through a second stage of articulation. The upper and lower cylinder units can be actuated sequentially or simultaneously to provide articulation through the full range thereof.

With the side-by-side assembly or boom arrangement, the link is connected on the common pivot axis between the booms. As applied to a stacked arrangement, the triangular link would straddle the booms at the articulated pivot support.

In both systems, the link and the booms are pivotally mounted on the common axis, preferably a shaft assembly, for free pivotal movement under the control of the cylinder units. The interconnection of the cylinder units to the link provides for the articulation of the upper boom either through the pivoting of the link as such or the pivoting of the upper boom relative to the link and its connection to the lower boom.

The link unit preferably includes aligned first and second one-piece triangular plates having aligned apexes. A common connector and boom connectors are secured to and join said plates at each apex of the plates, and each connector includes a pivot member with parallel axes for pivotal mounting of the booms and the link unit. In one construction the common pivot support includes a shaft assembly. The connectors at the boom apexes each includes a pin with the link unit having a hub journaled on the shaft. The cylinder units each includes a piston rod with an outer end journaled on the respective pivot pins and forming the sole interconnection of the booms to each other and to the support.

In the side-by-side boom assembly, the link unit is located between said booms and extends outwardly from the common pivot axis. The lower cylinder unit is located beneath said booms and in-line with the lower boom connector, with the lower cylinder unit extending outwardly between and beneath the booms from a pivotal connection to the lower boom to the lower boom connector. The upper cylinder unit is located above said booms and in-line with the upper boom connector and extends outwardly between and above the booms from a pivotal connection to the upper boom to the upper boom connector of the link unit.

In accordance with a preferred construction of the present invention, the link unit is an isosceles triangle having one apex mounted on a common pivot axis which extends between and supports the two booms. In the collapsed position, the link unit projects outwardly of the two booms. The lower boom pivot connection is located below the collapsed booms and the upper boom pivot connection is located above the collapsed booms. The hydraulic cylinder unit for the lower boom is connected to the underside of the lower boom with the cylinder connected to the lower boom and the piston rod projecting outwardly and coupled to the in-line pivot connector to the triangular link. The upper boom cylinder unit has the cylinder secured to the upper boom With the piston rod projecting outwardly into coupling with the aligned connector of the triangular link. The cylinder units are preferably located in a fully extended position with the booms in a collapsed storage state. If mounted in a fully retracted position, the spacing between the booms would have to be increased to allow the cylinders to move past each other. The attachment point for the cylinders to the link would also be adjusted for the wider spacing. The upper boom is raised by collapsing of the lower boom connected unit thereby pivoting of the link and the interconnected upper cylinder, which is firmly connected through the extended cylinder connected between the upper boom and the opposite aligned apex of the triangular link. By pivoting the first boom on its base support through approximately 135 degrees, and the upper boom pivoting about its pivot through approximately 275 degrees on the outer end of the first boom, it is possible to position the basket pivot on the end of the second boom throughout its entire envelope as shown at 55' (FIG. 5). The basket outer end can be moved horizontally or vertically by moving the first boom or the second boom independently about the lift structure. The operator can position the work platform as required by the movement of the two booms to reach the position desired.

In the articulation assembly of the invention, the link unit is not connected directly to either one of the booms but merely shares a common pivot axis, preferably a shaft unit or assembly on which the aligned ends of the booms are mounted. The cylinder units provide a boom connection to the link unit and thereby the only connection of the respective lower boom and upper boom to each other.

The present invention thus provides a simple, reliable and cost effective articulation assembly for interconnecting lower and upper booms for articulation through a substantial angle without cables, chains or multiple pivoting links.

BRIEF DESCRIPTION OF THE DRAWINGS

The drawings furnished herewith illustrate preferred constructions of the present invention in which the above advantages and features are clearly disclosed as well as others which will be readily understood from the following description of the illustrated embodiment.

In the drawings.

DESCRIPTION OF THE ILLUSTRATED EMBODIMENT

Figure 1:
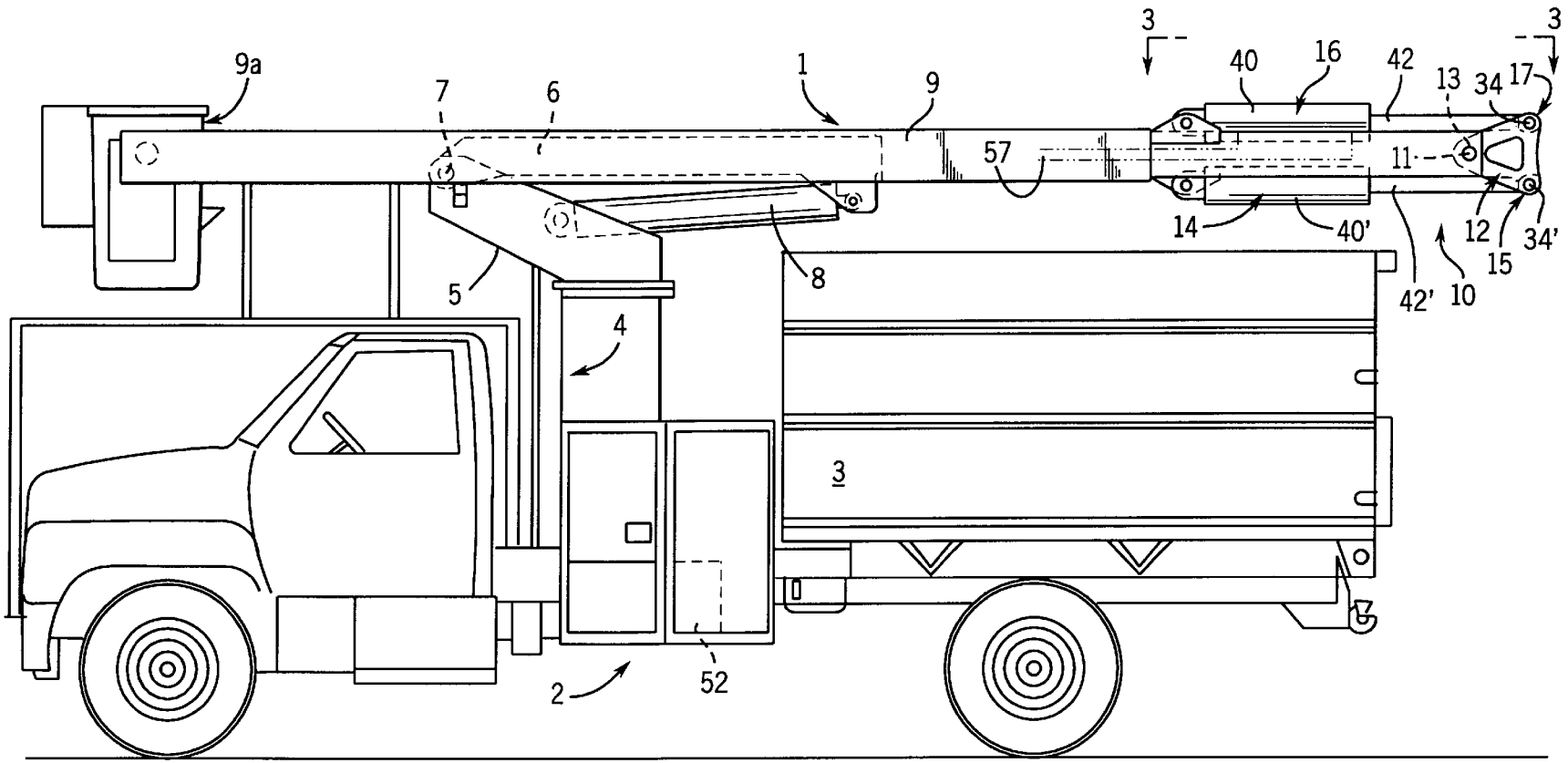
FIG. 1 is a side elevational view of a mobile aerial apparatus.

Referring to the drawings and particularly to FIG. 1, a mobile aerial system or unit 1 is illustrated including an embodiment of the present invention. In FIG. 1, the aerial unit includes a conventional truck unit 2 illustrated with the rearwardly extended bed 3 for supporting of a boom structure and associated structure. Generally, in accordance with common construction, a boom pedestal unit 4 is secured to the bed 3 which includes a boom connecting turntable assembly 5. The boom structure includes a lower boom 6 having an inner or mount end coupled to a pivot support unit shown as a shaft 7 of the turntable assembly 5. A lift unit 8, shown as a hydraulic cylinder unit, is connected between the turntable assembly 5 and the lower boom 6 and particularly the underside thereof. The hydraulic cylinder unit 8 provides the lift for pivoting of the lower boom 6 about the pivot shaft 7 for raising and lowering of the outer end of the lower boom relative to the pedestal and truck. In accordance with conventional construction, the pedestal unit 4 and turntable assembly 5 may include a bearing or pivot assembly to permit rotation of the pedestal about a substantially vertical axis and driven through a suitable gearbox and hydraulic motor or other suitable units for driving the vertical boom about such a pedestal axis. An upper boom 9 is connected to the outer end of the lower boom 6, with a personnel basket 9*a*, work platform or pivotally attached to the outer end of boom 9. Such structures are well known and no further description or illustration thereof is given other than as necessary to the description of the embodiment of the invention.

The upper boom 9 of the boom structure is connected and coupled to the outer end of the lower boom by a boom articulation unit or assembly 10 which particularly illustrates an embodiment of the present invention.

In the illustrated embodiment of the invention as shown in FIGS. 1–4, the lower and upper booms 6 and 9 are mounted in side-by-side relation in the collapsed and stored position. The articulation assembly 10 is interposed on each boom and between the two booms and includes a common pivot axis 11 for the booms and assembly. In accordance with the illustrated embodiment, the assembly 10 includes a single integrated link 12 having a first connector 13 pivotally mounted on the axis 11 and a common pivot axis with the two booms 6 and 9. A lower boom cylinder unit 14 is interconnected to the lower boom 6 and a lower boom connector 15 of the link 12. An upper boom cylinder unit 16 is connected to the upper boom 9 and an upper boom connector 17 of the link 12. The link 12 thus forms, through the hydraulic cylinder units 14 and 16, the physical connection between the lower and upper boom 6 and 9. The individual cylinder units 14 and 16 are actuated to pivot and set the link position and particularly the angular relationship about the common common axis 11 of the shaft which is coincident with the axis of the booms. The hydraulic cylinder units 14 and 16 provide a continuous and positive positioning of the link on the shaft and control of the boom locations at all times.

Figure 3:
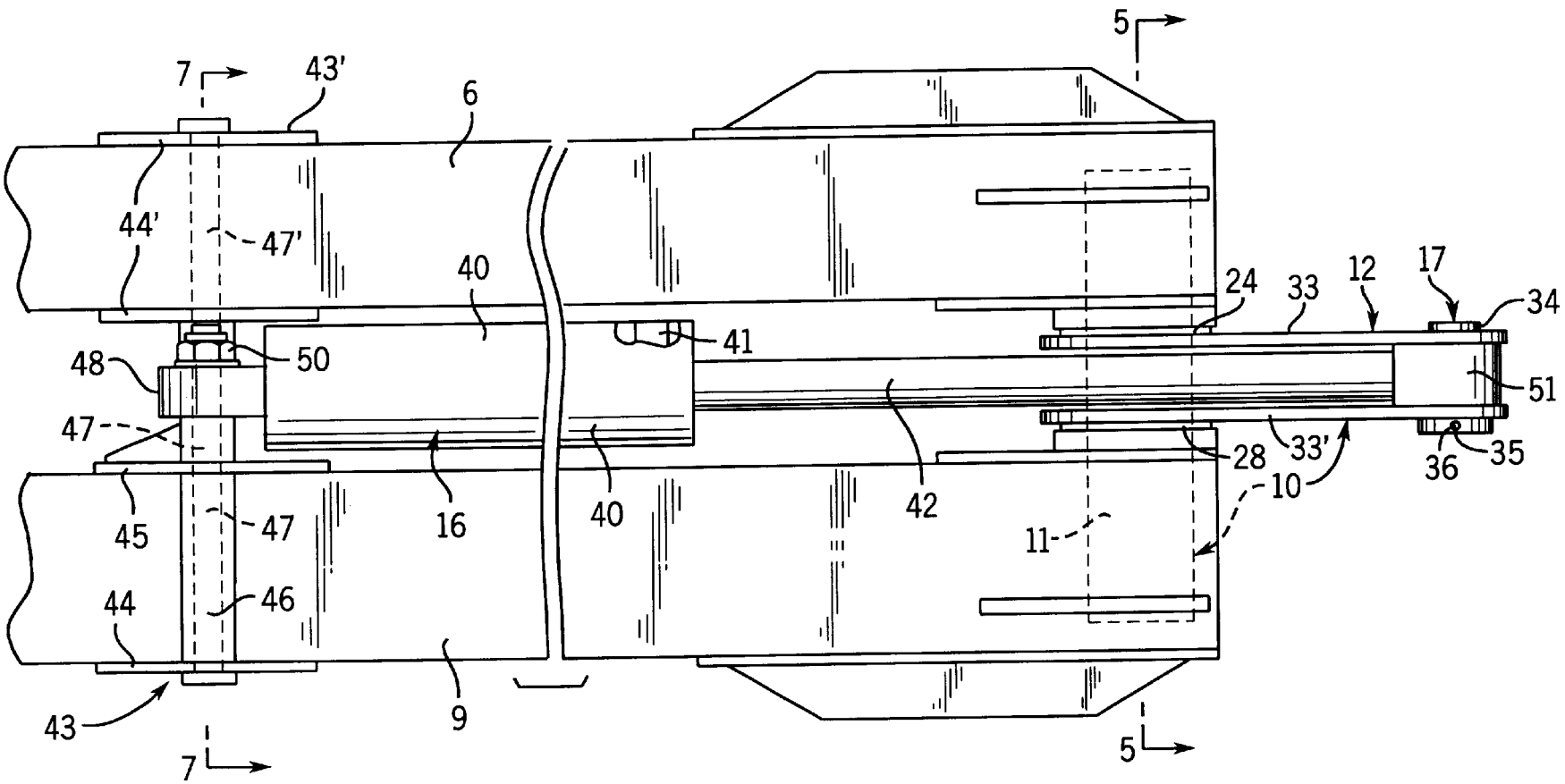
FIG. 3 is an enlarged top view of the boom apparatus shown in FIGS. 1 and 2, as shown by the line 3—3 in FIG. 1.
Figure 4:
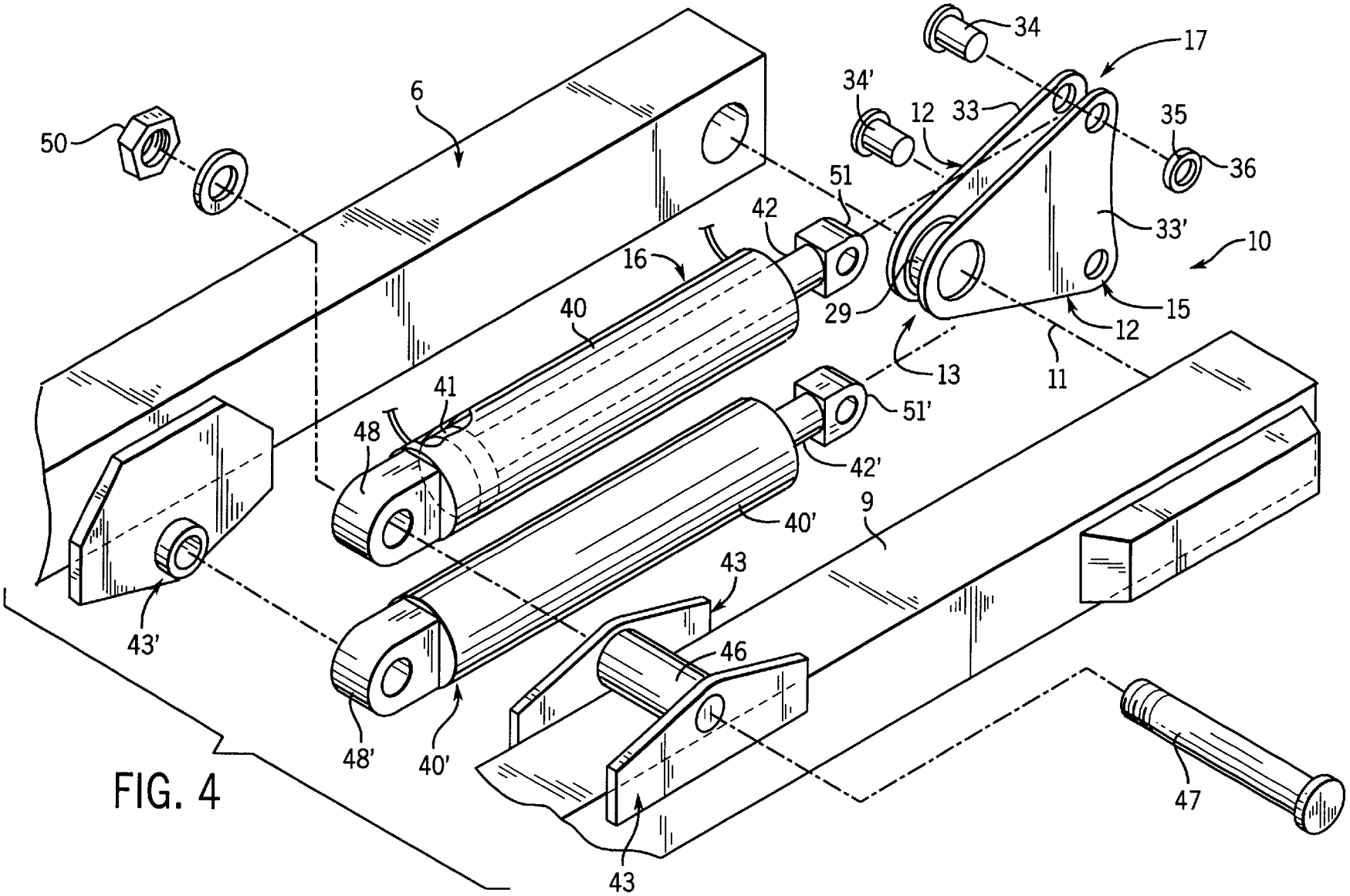
FIG. 4 is a partial exploded view of an articulation assembly shown in FIGS. 1–3.
Figure 5:
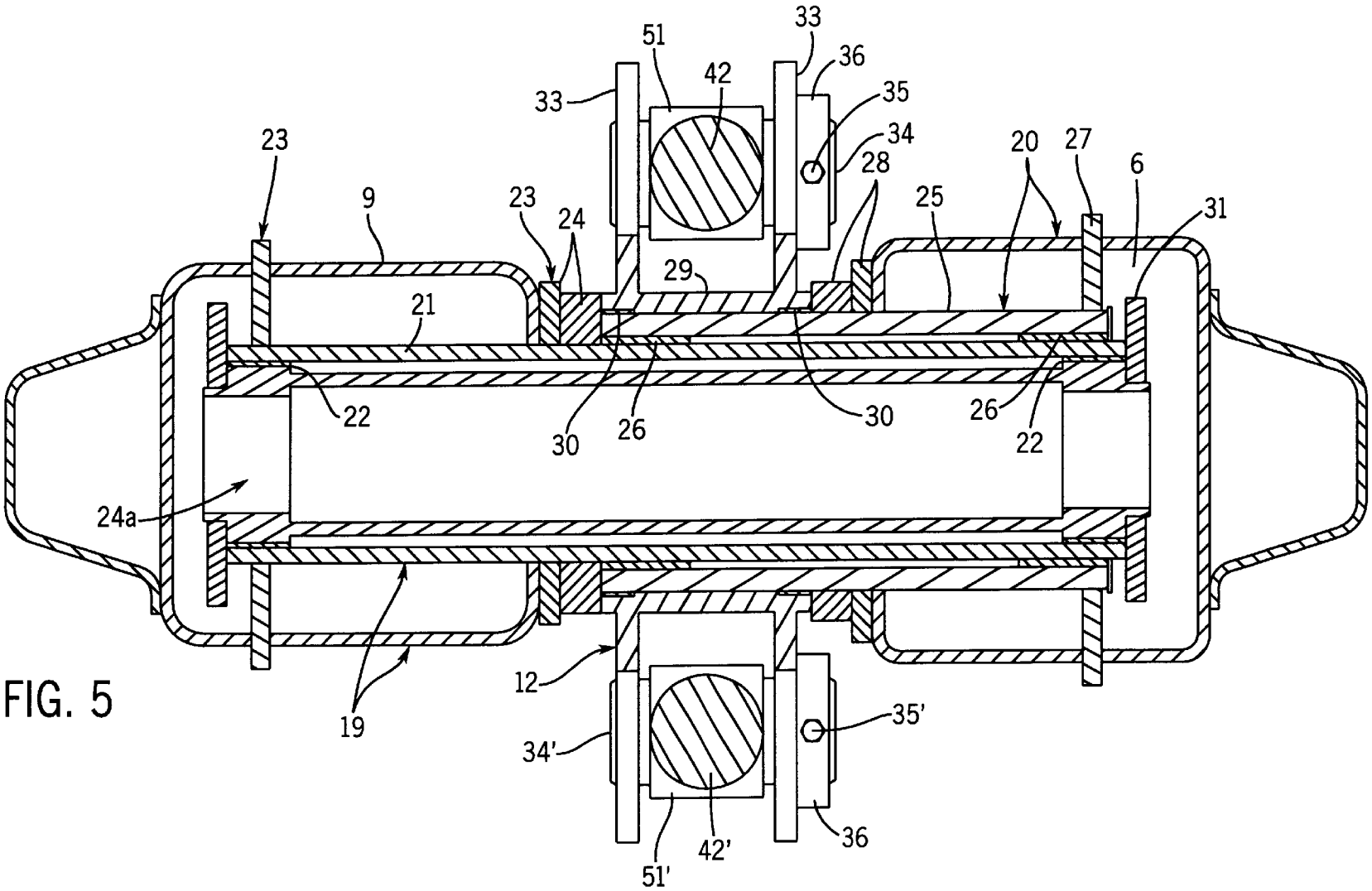
FIG. 5 is a sectional view taken on line 5—5 of FIG. 3.

Referring particularly to FIGS. 3–5, booms 6 and 9 are similarly shown as elongated tubular members having a rectangular, or circular cross section, with appropriate interconnected sections to provide the necessary strength and fabrication of the boom structures in accordance with known constructions. Generally, in a preferred construction, the boom may be formed of fiberglass with an appropriate steel articulated end portion.

Figure 6:
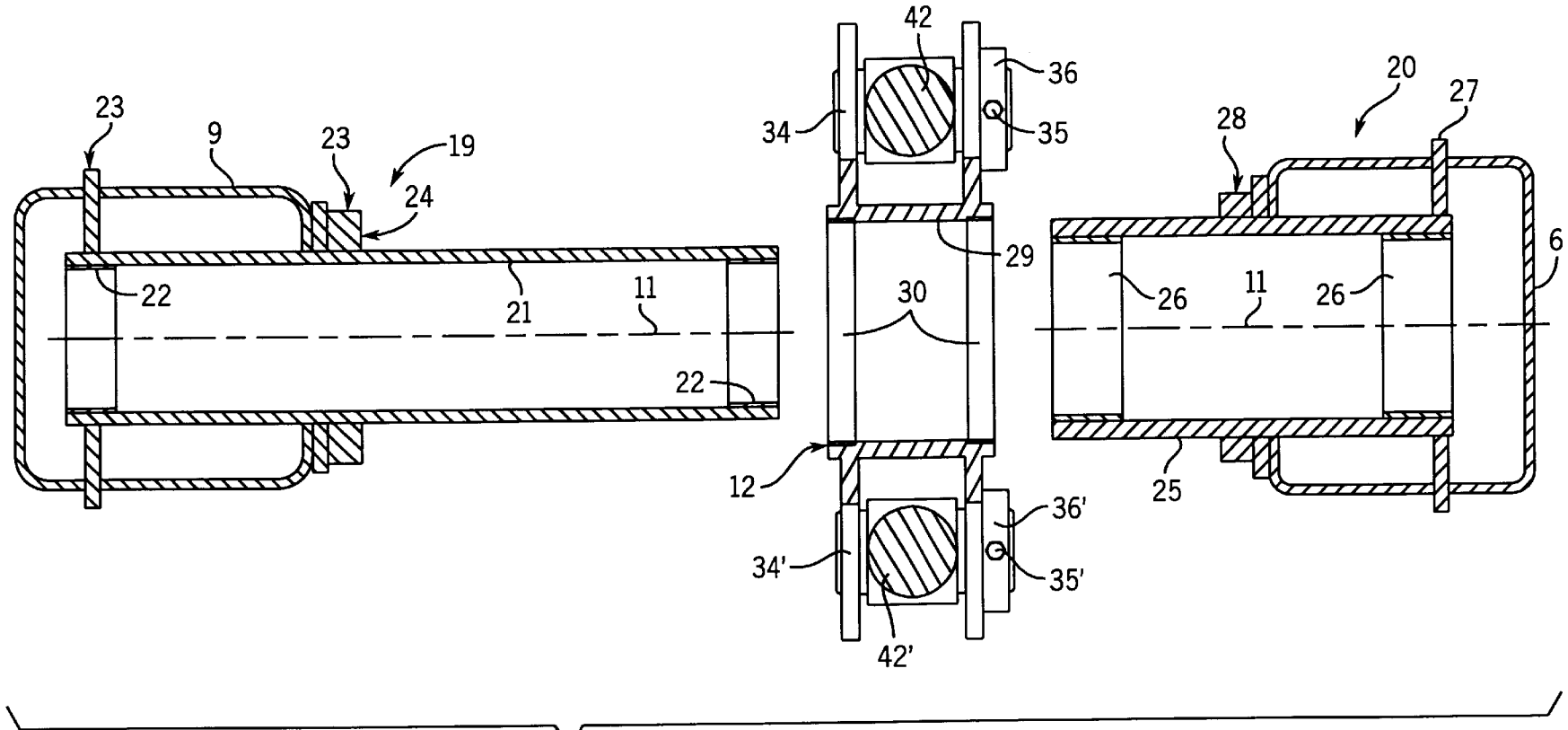
FIG. 6 is an exploded view of a portion of FIG. 5.

FIGS. 3–6 provide a more detailed view of the articulation assembly in a preferred construction forming the common pivot axis 11 at the elbow or articulation assembly 10. More particularly, the illustrated assembly includes an upper boom pivot structure 19 and a lower boom pivot structure 20 with the integrated linkage for link 12 rotatably mounted therebetween. In FIG. 6, the pivot structures 19 and 20 attached to the booms are shown as separated integrated elements, with the individual components as shown in FIGS. 3 and 5 illustrated in a welded assembly to form a single component structure for each boom for clarity of illustration and description.

The upper boom pivot structure 19 includes a tubular shaft 21 inclusive of the common pivot axis 11. Internal bearings 22 are secured within the opposite ends of the shaft 21. The one end of the shaft 21 projects into the upper boom 9 and the innermost end is secured to the boom as at 23. The securement at the right side of the boom 9 in FIGS. 3 and 5 include a spacer/bearing assembly 24 secured to the inner side of the boom 9 and the immediately adjacent portion of the shaft 21. As presently developed, the shaft 21 projects through the link 12 and the lower boom pivot structure 20, with assembly 24 abutting the link unit 12. The tube 21, element 23 and assembly 24 are formed as a welded subassembly with proper location of the elements and welds to produce a strong long-life structure. A leveling tube and sprocket assembly 24*a* is shown secured within the shaft 21 in FIGS. 3 and 5, within the spaced end bearings 22. The leveling shaft portion is a tubular member to permit the passage of the hoses through the booms and upwardly to the platform through the elbow or articulating assembly 10. Such structure is generally known in the art and is not further described.

The lower boom structure 20 is similarly formed as a subassembly as shown in FIG. 6 and includes a tubular shaft 25 having internal end bearings 26 secured to the opposite ends thereof. The interior diameter defined by the bearings substantially corresponds to the outer diameter of the tubular shaft 21. In the assembly as shown in FIGS. 3–6, the shaft 21 projects through the tubular shaft 25 with the bearings 26 rotatably supporting the lower boom pivot structure 20 on the common pivot axis 11. The upper boom structure 20, and particularly the shaft 21, projects inwardly into the lower boom 6 with a securement at the internal end, as at 27. Again, a spacer/bearing assembly 28 is secured and forms an integrated part as by welding between the inner wall or side of the boom 6 and the tubular shaft 25. In the assembled relation, the shaft 25 projects through the link 12.

The link 12 includes a bushing or hub 29 at the common connector 13 of the integrated link 12. Bearings 30 are secured within the opposite end of the hub, with the lower boom shaft 25 extending therethrough and with the link pivotably supported on the shaft 25 and thereby on the common pivot axis 11. The spacer/bearing assemblies 24 and 28 of structures 19 and 20 abut the opposite ends of hub 29. The total assembly of structures 19 and 20 and the link 12 are secured, as shown in FIGS. 3 and 5, by snap ring 31 secured to the end of the shaft 21 projecting from the tubular shaft 25. The snap ring 31 on the shaft 21 abuts the inner end of the shaft 25 and firmly supports the assembly as an integrated unit with the common pivot axis 11 as shown in FIG. 1 as well as all other figures.

Figures 6A, 7:
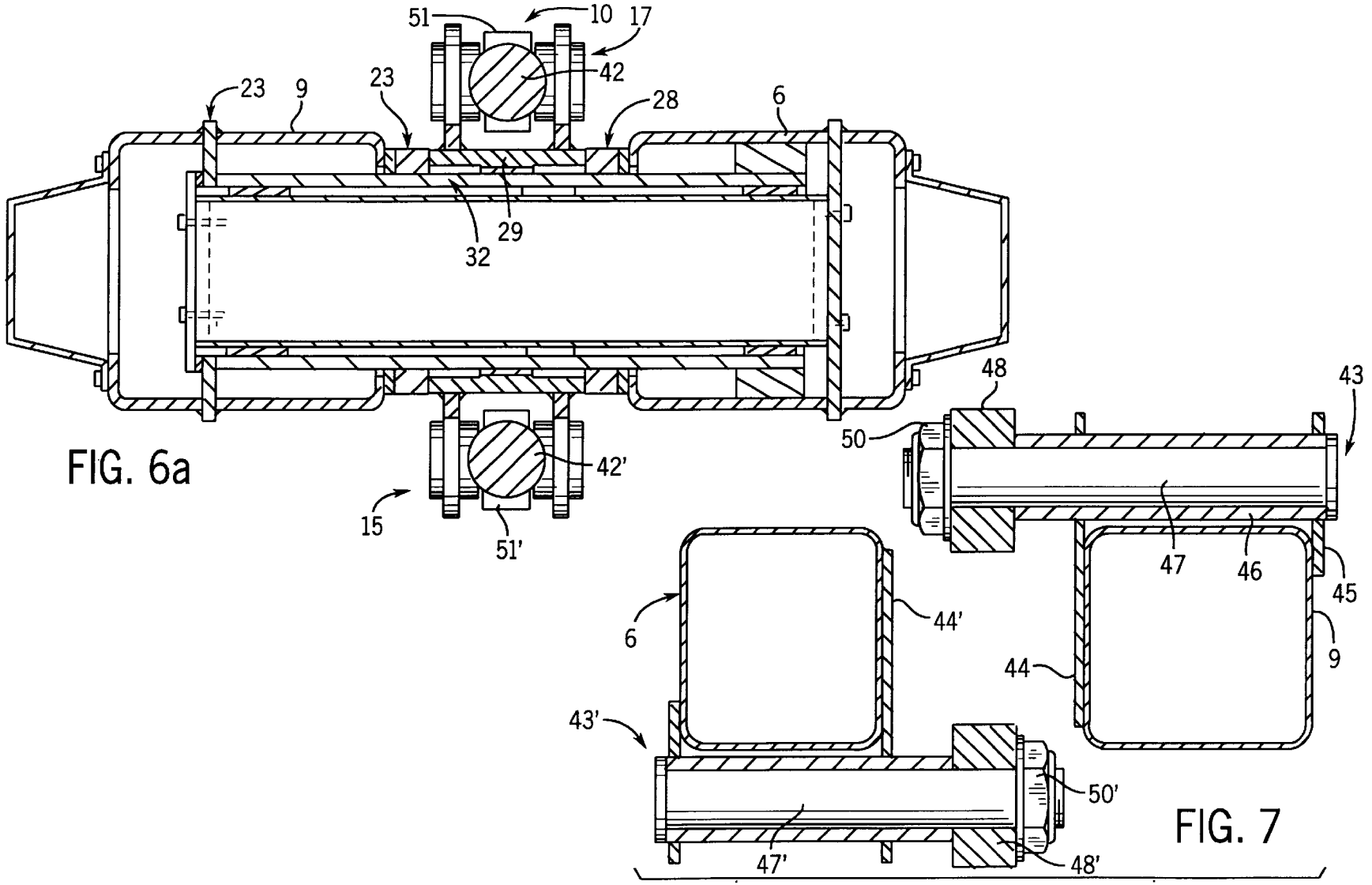
FIG. 6*a* is a view similar to FIG. 5 of an alternate embodiment.
FIG. 7 is a section taken generally on line 7—7 of FIG. 3.

Although the illustrated articulation assembly of FIGS. 3–5 is preferred, a single shaft assembly could be employed such as shown, for example, in FIG. 6*a*. In this embodiment, a single shaft 32 is shown extended through the opposing sides of booms 6 and 9 and the hub 29.

However, the construction of FIGS. 3–5 is preferred as providing preferred and minimum load distribution with respect to the assembly. Thus, in the common shaft embodiment, there can be an increased deflection because the boom pivot bearings will be at the boom ends and the cylinder forces are all in the center of the link. Such an assembly will result in a higher load on the inner bearings. The preferred construction provides for a more effective location of the bearings and particularly a more central location to minimize bearing load and deflection as a result of the cylinder forces. The construction of FIG. 6 with the inner most shaft 21 attached to the upper boom 9 and the larger shaft 25 attached to the lower boom 6 could be reversed. The larger shaft could be a part of the upper boom. The function of the system will not change.

The link 12 projects outwardly from the hub 29 forming connector 13 between the booms 6 and 9 with the second and third apexes and connectors 15 and 17 of the triangular link located outwardly of the booms 6 and 9 and interconnected to the respective hydraulic cylinder units 14 and 16, as more fully described hereinafter, for the angular orientation of the booms.

The illustrated link 12 includes similar triangular plates 33 and 33' which are welded or otherwise affixed to the hub 29. The plates extend outwardly with the connectors 15 and 17 vertically aligned in the storage position and connected to the respective booms. Each of the connectors has a pivot pin 34, 34' releasably secured to the outer ends of plates 33, 33'. The pins 34 and 34' are similarly locked in place by a locking screw 35, and 35' in a collar 36 and 36' secured to the outer side of the respective plates 33 and 33'.

Referring to the upper boom 9 as shown in FIGS. 2–4 and 7, the upper hydraulic cylinder unit 16 includes a cylinder 40 having a piston 41 therein and a piston rod 42 projecting from the one end of the cylinder 40. A rigid bracket or saddle 43 is shown welded to the top side of the upper boom 9. The saddle 43 consists of a pair of spaced plates 44 and 45 which are secured as by welds to the opposite sides of boom 9 and a pivot member shown as a tube 46, is generally secured between the two plates. A pivot pin 47 extends through the saddle 43 and projects across the opening or spaced between the booms 6 and 9. The cylinder 40 includes a closed base with a pivot plate or bracket 48 extending outwardly. The pivot pin 47 extends therethrough and is locked onto the pivot bracket 48. In the illustrated embodiment, a lock nut 50 is secured to a threaded end of the pivot pin 47 to firmly secure the cylinder 40 to the saddle 43 and thereby the upper boom 9. In practice, a suitable pin may be rigidly connected to the saddle 43 and fixed within the cylinder bracket 48.

The cylinder unit 16 extends outwardly between the two booms. The piston rod 42 extends outwardly with the outer end, having a lubricated pivot hub 51 journaled on the pivot pin 34 in the outer apex and connector 17 of the triangular link 12.

The cylinder 40 is constructed and connected to a hydraulic supply 52 via lines 53 (diagrammatically shown in FIG. 1) and locates the piston rod 42 in a fully extended position with the boom 9 in the collapsed storage position. The hydraulic lines 53 from the supply extends through the boom structure of the lower boom and the upper boom for retraction and extension of the cylinder unit 16 including the tubular member of the leveler to the platform control valve.

As shown in FIGS. 1 and 4, the apex and connector 15 of the link 12 is located slightly below the collapsed booms 6 and 9 in the storage position. The cylinder unit 14 is similarly connected to the lower boom 6, and in particular, to the underside of the lower boom, and to the connector 15, with corresponding elements identified by primed numbers. In summary, the interconnection includes the pivot units or structures 43'–48' connected to the closed base of the lower boom cylinder unit 14. The piston rod 42' projects outwardly, and in the stored boom position, the outer end includes the hub or bracket 51 pivotally mounted on the pivot pin 34' of the connector 15 of the link unit 12. The cylinder 40' is connected through suitable hydraulic lines to the hydraulic supply 53, as previously discussed. In the collapsed, position of the illustrated embodiment, the lower cylinder unit 14 is also in a fully extended position and forms the only powered interconnection to the lower boom other than the lift cylinder unit 8.

Thus, the articulated ends of the lower boom 6 and the upper boom 9 are solely interconnected to each other through the cylinder rod connections to the pivoting link 12. The free pivoting link 12 provides for rotation about the common pivot axis 11 and for free powered pivoting of the two booms 6 and 9 about the other two spaced apexes and connectors of the link 12.

Figure 2:
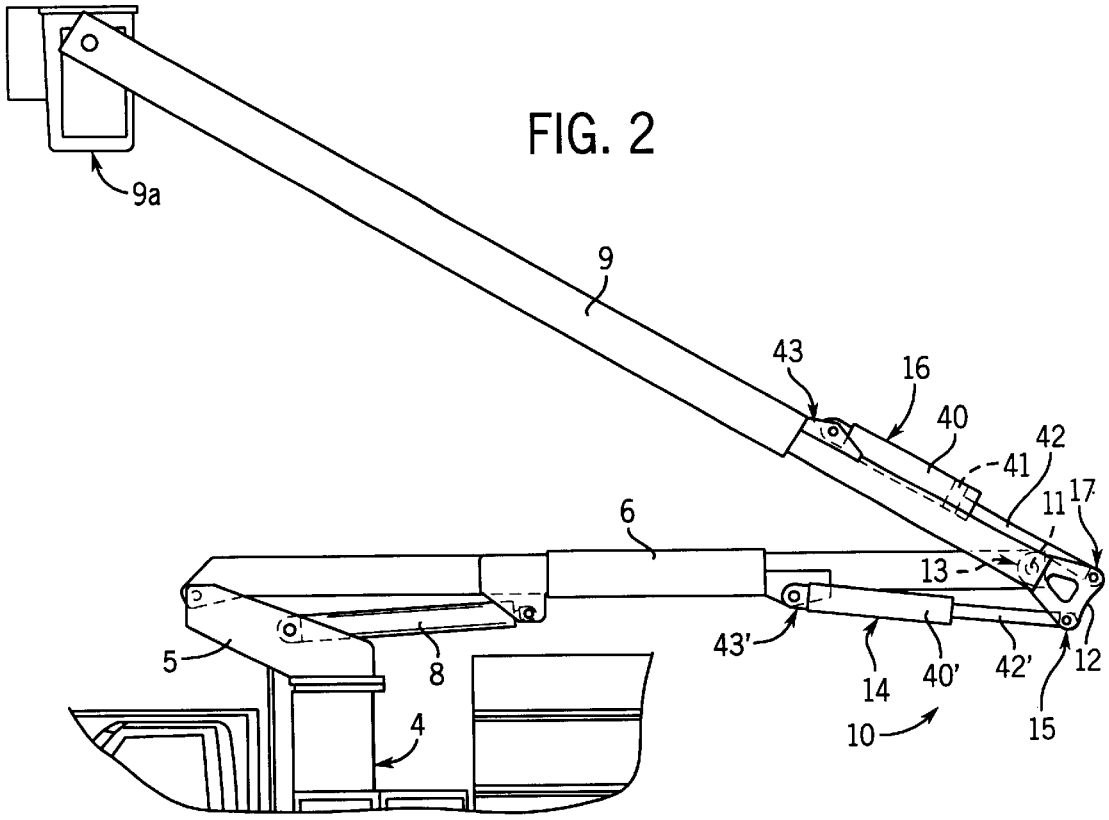
FIG. 2 is an enlarged side elevational view of a boom apparatus shown in FIG. 1 in a partially extended position.
Figure 8:
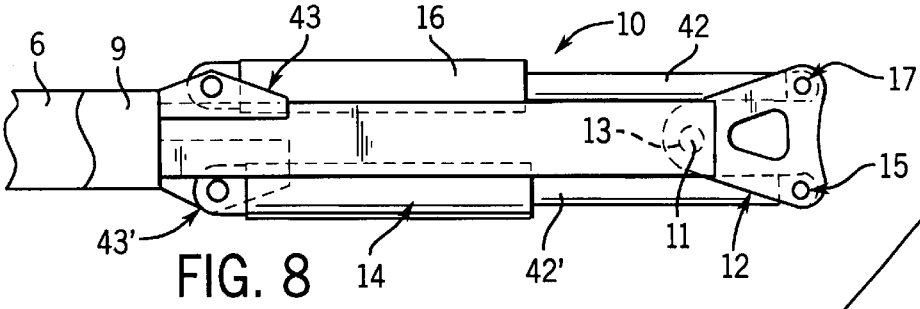
FIGS. 8 through 11 are views of the articulation assembly and the outer ends of the booms illustrating the articulated movement of the booms.
Figure 9:
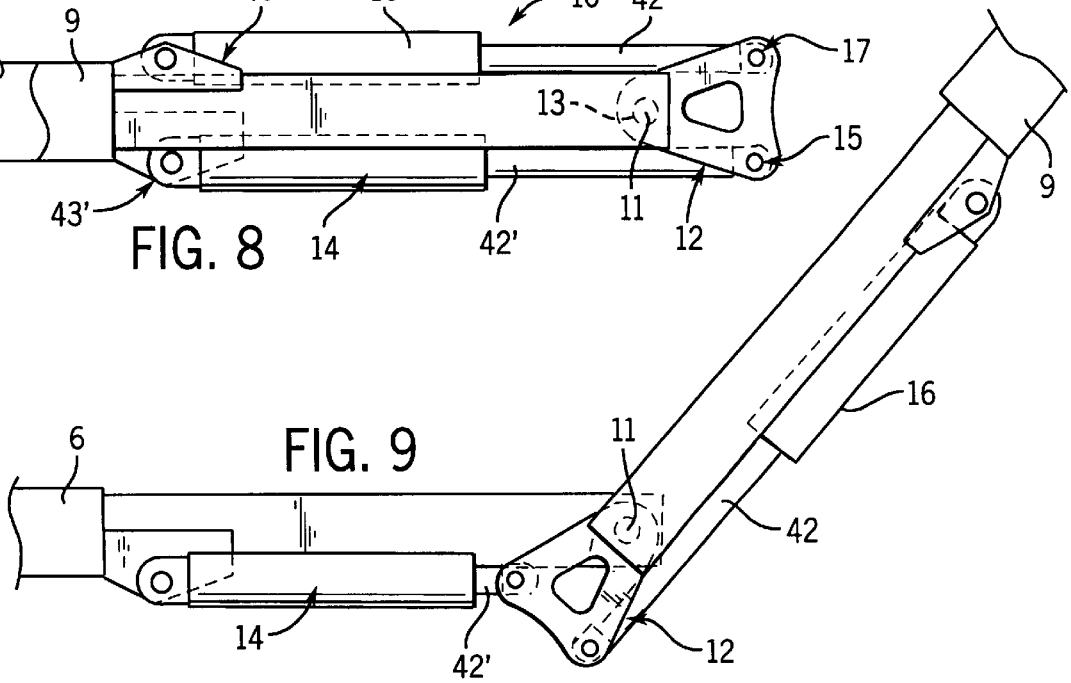
Figure 10:
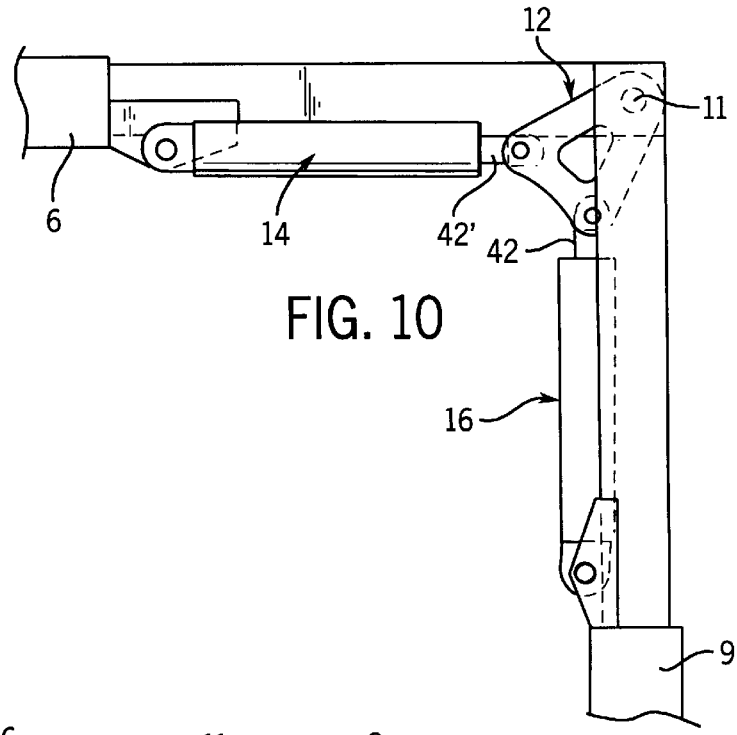
Figure 11:
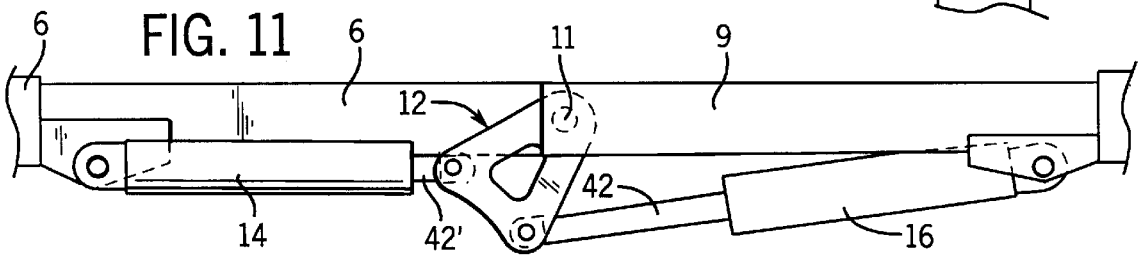

In the storage position of FIGS. 1, 2 and 4, the cylinder units 14 and 16 are in a full extension position, with the only connection to the booms through the articulation assembly 10, and particularly the free pivoting link 12. The cylinder units 14 and 16 pivot the lower and upper booms relative to each other through the retraction and extension of the respective upper and lower cylinder unit as shown in FIGS. 8–11. Referring to FIGS. 8 and 9, retraction of the lower cylinder unit 14, connected to the lower boom 6 and the connector 15 of link unit 12, moves the upper boom 9 through an initial stage of articulation, as follows. The upper boom cylinder unit 16 is locked and held in the extended position of FIGS. 8 and 9, and retraction of the cylinder rod 42' of the lower cylinder unit 14 requires and causes the link 12 to pivot on the common axis 11. As the link 12 pivots, the upper cylinder unit 16 pivot clockwise as shown in FIG. 9 to raise the upper boom 9 upwardly and outwardly of the lower cylinder unit 14 and the connected lower boom 6. The link unit 12 with the equal arms between the common shaft connector 13 and the two cylinder connectors 15 and 17 establishes rotation of boom 9 through 135 degrees in the fully retracted cylinder position. With the lower cylinder unit locked in place as in FIG. 9, the upper cylinder unit 16 can be retracted and moves the link unit 12 and upper boom 9 through a second stage articulation, as a result of clockwise pivoting of the link unit 12 and moving the upper boom 9 clockwise in the position of FIG. 10. Thus, the latter rotation of the link unit 12 also moves the boom 9 through 135 degrees. The total relative movement of boom 9 is thus 270 degrees. If the upper boom cylinder unit 16 is partially retracted, a proportional clockwise movement is made from the position of FIG. 9, such as shown in FIG. 11.

Although described as a separate movement for clarity of explanation, the articulation of the booms 6 and 9 can simultaneously be established by operation of simultaneous retraction or extension the cylinder units 14 and 16, with the pivoting of the link 12 on the common axis 11.

Figure 12:
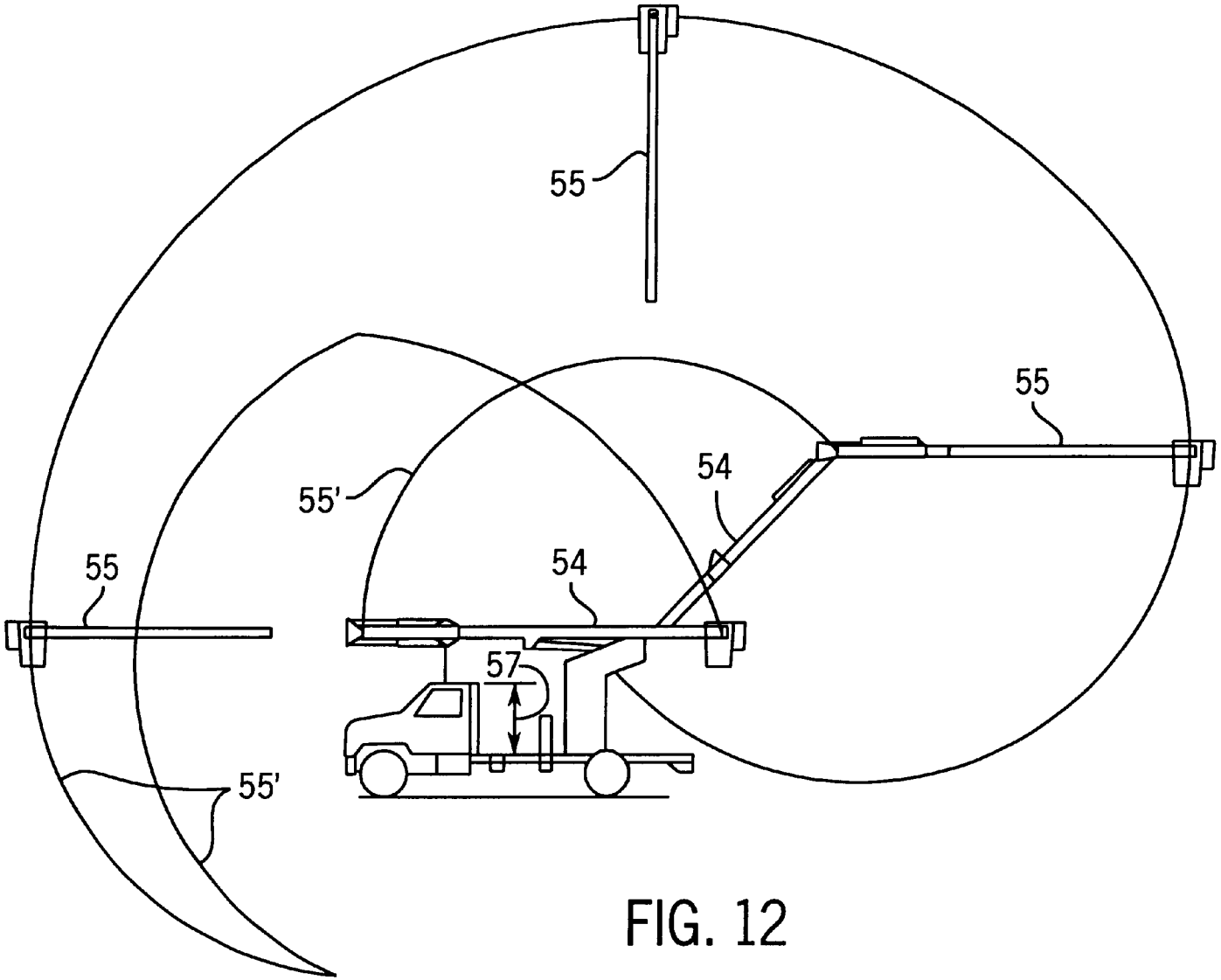
FIG. 12 is a view illustrating the available movement of the booms.

Referring particularly to FIG. 12, various total and partial articulations of a boom assembly with an illustrated embodiment of the invention is shown. FIG. 12 illustrates the boom assembly located with the boom assembly mounted in a reverse position relative to FIG. 1.

The lower boom 6 can be positioned between the horizontal stored position and various raised positions inclusive of about 135 degrees, as at 54, by activation of the lower boom cylinder unit 8. The lower and upper booms 6 and 9 can be rotated and by contraction and expansion of the respective upper and lower boom cylinder units 14 and 16 within specified limits as shown by the lines 55.

The reference to the angular movement on the order of 270 and 275 degrees describes practical limits on the movement. A somewhat greater degree may be achieved, but would probably result in a lower capacity.

In summary, the single link unit 12 with the supporting connection of the booms 6 and 9 being only through the cylinder units 14 and 16 and the link unit provides a simple, reliable and cost effective system for positioning of an upper boom relative to a lower boom.

The pivot link unit may also be used in stacked boom arrangement with the link constructed to straddle the two beams.

Figure 14:
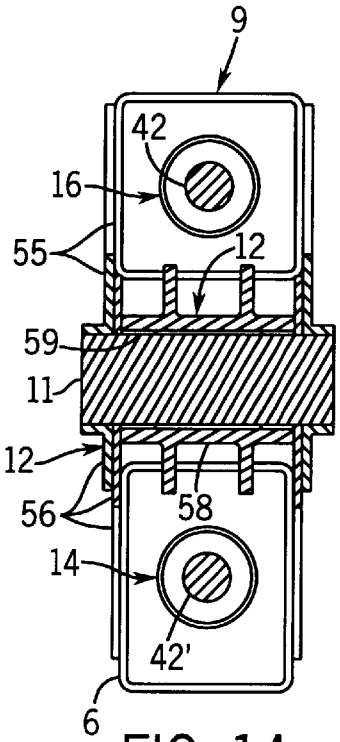
FIGS. 13 and 14 are views of an embodiment including vertical stacked oriented booms.
Figure 13:
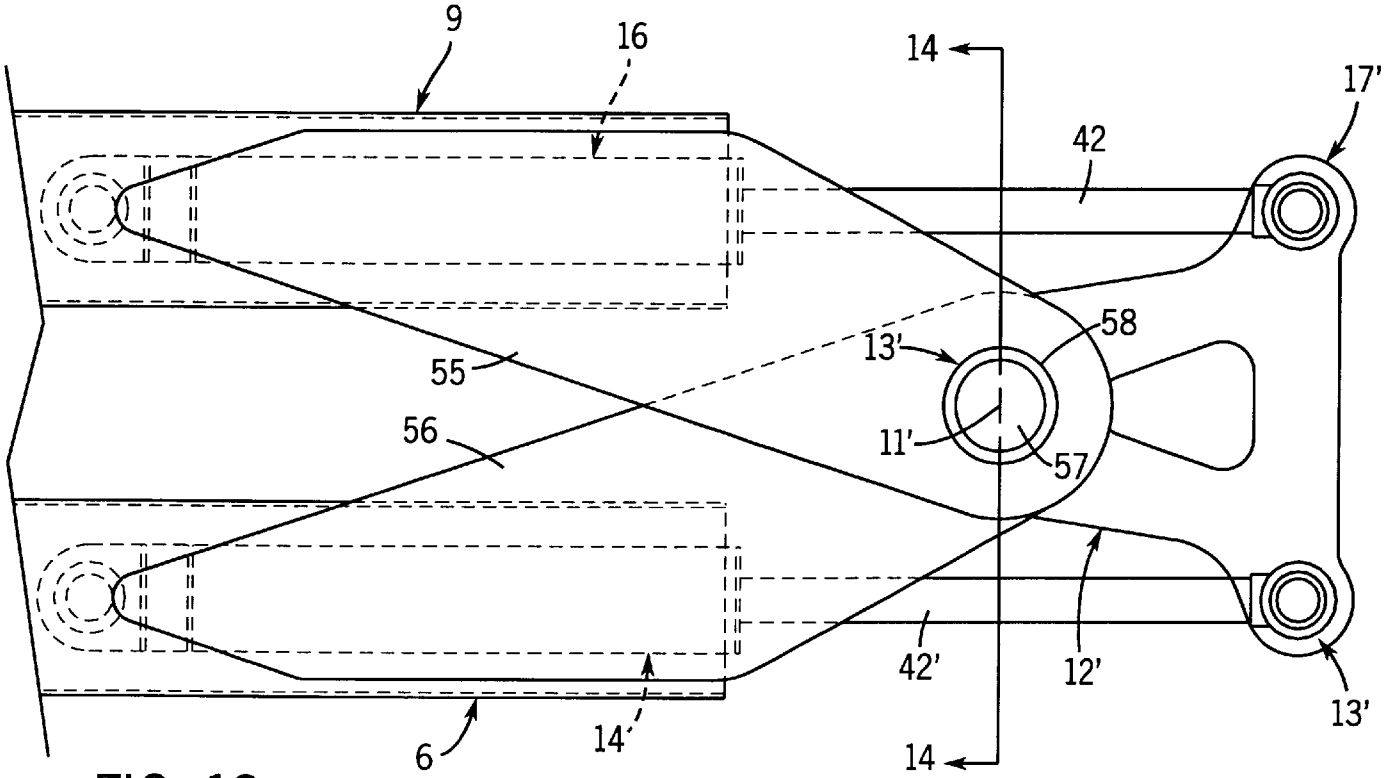

FIGS. 13 and 14 illustrate a stacked or vertical orientation of the booms 6 and 9 with a single link in accordance with the present invention. Corresponding prime numbers have been applied to the several corresponding elements illustrated in this embodiment and shown in the first embodiment.

Referring to FIGS. 13 and 14, the upper and lower booms 6' and 9' are illustrated with the respective cylinder units 16' and 14' connected thereto. Similarly, a single link 12' is illustrated and the various elements connected thereto to provide a similar pivoting of the system on a common axis 11'.

Referring to FIG. 13, the cylinder units 14' and 16' are mounted internally of the respective booms 9 and 6, with the cylinder 40' and 40" internally mounted and the piston rods 42 and 42' projecting outwardly to the corresponding connector of the link 12'. The common axis connector 13' of the link 12' is located centrally between the vertical orientation of the booms 6' and 9' in the stored position. The booms are similarly connected to the common pivot axis by separate rigid plates 55 and 56. The plates are welded or otherwise rigidly secured to the opposite sides of the respective booms with an angular projection to the center axis 11'. The plates are located and pivoted on the opposite ends of a shaft 57 of the connector 13' as shown in FIG. 14. The connector 13 thus includes a hub 58 mounted on the central common shaft 57 defining the common pivot axis 11' with suitable interposed bushings or bearings 59 to permit pivoting of the link 12. The plates 55 and 56 are secured and held in place on the shaft 52 to permit the free pivoting of the cylinder units and the connected booms. The piston rods 42' and 42" of cylinder units 16 and 14 respectively are pivotally mounted in the connectors 15' and 17' of link 12'. The fixed common pivot axis 11' for the booms and the link establish the same relative movement of the booms created by the retraction of the respective piston rods 42' and 42". Those skilled in the art will readily recognize that the system of FIGS. 13 and 14 operate essentially in the precise manner as previously discussed with respect to the side-by-side orientation. In view of the above, no further description with respect to vertical oriented booms is set forth herein.

As disclosed in the preferred construction, the integrated link is illustrated as an equi-lateral triangle with the link sides substantially equal. Similarly, the cylinder units 14 and 16 are shown having substantially identical lengths and sizes.

Variations in such components and others can be readily supplied by those skilled in the art including the size and arrangement of the link as well as the length and/or size of the cylinder units. For example, if different spacing was available for each of the boom cylinder units, the one cylinder unit could be larger in diameter but shorter in stroke while providing the desired articulation.

The cylinder units may be designed in a fully retracted position. Further, the cylinder units may have the cylinders connected to the respective connectors of the link and the piston rods connected to the respective booms. However, the distance or spacing between the booms would necessarily be increased to permit the cylinders to pass each other as they are extended.

The link is shown in a preferred construction but may be otherwise constructed as a single member or other plurality of members interconnected to function as a single link unit and with the three point connection including a free pivot connection and powered positioning pivotal connections to the two respective booms as the physical coupling of the booms for the boom articulation. Further, the angular movement may be varied by varying the distance between the link pivot locations and the respective boom connector pivots, if necessary or desired for other specifications.

The hydraulic cylinder units are preferred positioning units, any substantially extendible and rigid positioning devices can be used within the teaching of the present invention. Thus, a rack and pinion unit, a screw driver unit and other suitable mechanism which produces the positioning and holding forces required, with the free pivoting of a link unit and the boom units can be used.

Various modes of carrying out the invention are contemplated as being within the scope of the following claims particularly pointing out and distinctly claiming the subject matter which is regarded as the invention.

I claim:

1. An articulated boom assembly comprising:

a lower boom, an upper boom aligned in spaced parallel relation to the lower boom, said lower boom and said upper boom located as side-by-side booms in a collapsed stored position, said booms having adjacent articulation ends, a common pivot support located between and connected to said articulation ends with the booms freely pivoting on a common axis, an articulation link unit having a common connector pivotally mounted on said common pivot support between said articulation ends of said booms and pivoting on said common axis and extending outwardly thereof and having an upper boom connector located in alignment with said upper boom in said stored position and a lower boom connector located in alignment with said lower boom in said stored position, an extendable and retractable lower boom positioning unit including a lower hydraulic cylinder unit having a cylinder with a closed end connected to said lower boom and having a piston rod extending outwardly of the opposite end of said cylinder and connected to said lower boom connector of said link unit in said stored position and operable to pivot said link unit on said common pivot support, an extendable and retractable upper boom positioning unit including an upper hydraulic cylinder unit having a cylinder with a closed end connected to said upper boom and having a piston rod extending outwardly of the opposite end of said cylinder and connected to said upper boom connector in said stored position and operable to pivot said link unit on said common pivot support, said common pivot support and said upper boom connector and said lower boom connector forming a triangular support with said positioning units and said booms substantially aligned with each other in said stored position, whereby said upper hydraulic cylinder unit and said lower hydraulic cylinder unit are independently and separately operable to pivot said link unit and are conjointly operable to pivot said link unit and said operation of said upper and lower hydraulic cylinder units positions said upper boom relative to said lower boom from said stored position, and wherein said link unit includes at least first and second one-piece triangular plates having aligned apexes, said common boom connector and said upper boom connector of said lower boom connector are secured to and join said plates at each apex of the plates, each connector includes a pivot member with parallel axes, and wherein said common boom connector includes a shaft unit, said shaft unit includes an upper boom shaft connected to the upper boom and a lower boom shaft connected to the lower boom, one of said shafts being a tubular shaft and extending over the other of said shafts and being pivotal on said other of said shafts, and said link unit including a tubular shaft connecting said first and second plates and with said tubular shaft of said link unit pivotally mounted on said first named tubular shaft between said booms.

2. The boom assembly of claim 1 wherein said lower hydraulic cylinder unit being located beneath said booms and in-line with said lower boom connector of said link unit, a connector secured to the lower boom and having a lower pivot member extending laterally inwardly from beneath the booms, said lower hydraulic cylinder unit attached to said lower pivot member and extending outwardly between and beneath the booms to said lower boom connector of said link unit, said upper hydraulic cylinder unit located above said booms and in-line with said upper boom connector of said link unit, a connector secured to the upper boom and having an upper pivot member extending laterally inwardly from above the booms, said upper hydraulic cylinder unit attached to said upper pivot member and extending outwardly between and above the booms to said upper boom connector of said link unit.

3. The boom assembly of claim 2 wherein said common pivot support includes a pivot shaft unit, said link unit includes a first and second triangular plates arranged in spaced aligned relation with common apexes, a pivot journal secured to a first apex of the plates and mounted on said common pivot support, pivot pin members connected to the second and third apexes of said plates, said piston rods of said upper and lower cylinder units being one each connected to said respective pivot pin members.

* * * * *